US006345395B1

(12) United States Patent
Chilton

(10) Patent No.: US 6,345,395 B1
(45) Date of Patent: Feb. 12, 2002

(54) SPORTS HAT

(76) Inventor: Shawn Chilton, 20819 Hart St., Canoga Park, CA (US) 91306

( * ) Notice: Subject to any disclaimer, the term of this patent is extended or adjusted under 35 U.S.C. 154(b) by 0 days.

(21) Appl. No.: 09/599,177

(22) Filed: Jun. 22, 2000

(51) Int. Cl.[7] ..... A42B 1/22

(52) U.S. Cl. ..... 2/183; 2/171.4; 2/171.02; 2/202

(58) Field of Search ..... 2/202, 183, 171.4, 2/171.02, 171.1

(56) References Cited

U.S. PATENT DOCUMENTS 1,582,812 A * 4/1926 Avin ..... 2/202
1,725,425 A * 8/1929 Steingold ..... 2/202
3,340,542 A * 9/1967 Greenwald ..... 2/202
3,698,014 A * 10/1972 Little et al. ..... 2/84
3,714,670 A * 2/1973 Pollack ..... 2/197
5,251,336 A * 10/1993 Nevins ..... 2/202
5,309,574 A * 5/1994 Balaban et al. ..... 2/202
6,049,904 A * 4/2000 Siracusa ..... 2/4
6,052,830 A * 4/2000 Payne ..... 2/171.1

* cited by examiner

*Primary Examiner*—Bibhu Mohanty
(74) *Attorney, Agent, or Firm*—Colin P. Abrahams

(57) ABSTRACT

A sports hat comprises a body including a domed portion having a narrow end and an open wide end, and a ring portion of variable diameter at the narrow end. An elasticized band is associated with the ring portion, as is a substantially non-stretchable elongate drawstring. The elongate drawstring is adjustable between a loosened position and a tightened position to limit the diameter of the ring portion.

20 Claims, 3 Drawing Sheets

SPORTS HAT

FIELD AND BACKGROUND OF THE INVENTION

This invention relates to sports hats in general, and particularly to hats which may be useful to those engaging in water sports. The sports hat of the invention has particular application for surfers, although it is not, of course, confined to such users.

Preferably, the sports hat of the invention is designed to retain body warmth, and at the same time have properties whereby water within the fabric of which the sports hat is made is not retained, so that when the hat becomes fully or partially saturated with water, the water is quickly removed away from the user's head and/or ears, but at the same time, maintaining body heat.

Sports hats, caps and other forms of headgear are well known, and certain forms of headgear may be particularly adapted to specific activities and sports. Thus, for example, a range of different headgear may be available for skiers, in order to keep the head and ears warm and dry during skiing. Also well known in the art are swimming caps, donned by swimmers for their light weight properties, and to present a smooth rounded surface to reduce friction in the water. Further, headgear for use by boxers is designed to protect the ears and brain of the boxer from punishing blows and skin cuts.

SUMMARY OF THE INVENTION

The present invention is designed for, and has features useful to, those involved in water sports. The sports hat of the invention has been designed with particular attention to surfers, and their need for headgear which not only retains body warmth to keep the head warm, but also resists or repels retention of water within the fabric constituting the sports hat so that the water, or a substantial part thereof, in the fabric easily flows out of or runs off the sports hat.

The sports hat of the invention incorporates various design features useful to swimmers and surfers. In this respect, the sports hat of the invention may be comprised of a series of segments forming a dome portion, the segments having a particular shape which enables the sports hat to be worn, if desired, over the forehead, but slightly elevated at the back of the head so as not to interfere with wet suits or other clothing items being worn by the user. Further, the sports hat may incorporate a headband which includes an elasticized portion, attachment or insert to ensure that the hat remains firmly on the head, especially during use in the ocean, where wave conditions may be sufficiently forceful to knock the hat right off the user's head. The headband may further incorporate an adjustable drawstring which can be used to further tighten, or loosen, the hat, so that the specifics of its fit can be adjusted or varied according to the outside conditions.

The sports hat of the invention may also incorporate a chin strap, preferably elasticized, and conveniently attached to the headband, and which can be easily placed under the chin of the user. When not in use, the chin strap can simply be tucked in to the hat itself.

It should also be noted that the materials which comprise the sports hat may be carefully chosen to prevent water retention, but also to retain the body heat of the user. Preferably, the sports hat of the invention may be comprised of Polartec™ (manufactured by Malden Mills) which is a fabric that rapidly syphons away moisture from the body, and dries quickly. Thus, even when the hat has been saturated with water, this water is quickly removed from the surfer's head, and body heat is maintained. Fabric which also "breathes" in that it permits an exchange or flow-through of air between the environment and the user's head, is preferable. So, too, is the use of a fabric which is light-weight in construction, and allows body moisture to pass through it to minimize sweat buildup within the hat.

It has been found that the use of a sports hat incorporating the various designed features, or at least some of them, mentioned above provides a comfortable and effective garment which keeps the head dry and warm, at the same time allowing breathability and sweat drainage.

According to one aspect of the invention, there is provided a sports hat comprising: a body including a domed portion having a narrow end and an open wide end, and a ring portion of variable diameter at the narrow end; an elasticized means associated with the ring portion; and a substantially non-stretchable elongate member associated with the ring portion, the elongate member being adjustable between a loosened position and a tightened position to limit the diameter of the ring portion.

Preferably, the domed portion has a front and a rear, and the rear has a cutaway section at or near the wide end thereof. The domed portion may have a pair of front panels and a pair of rear panels, each panel comprising approximately one quarter of the domed portion. Each of the front panels may be substantially triangular in shape with a pair of substantially equal side edges and a base edge, and each of the rear panels is substantially triangular in shape with a longer and a shorter side edge and a base edge. The shorter side edges of adjacent rear panels may be fixed to each other, the longer side edge of a rear panel may be fixed to a side edge of the front panel, and the pair of front panels may be fixed to each other along adjacent side edges. The ring portion may be fixed to the base edges of the front and rear panels.

Preferably, the ring portion defines a circular channel therein and the elasticized means and the elongate member are at least partially located within the circular channel. The ring portion may have a pair of apertures near the rear thereof, and the elongate means has a closed-in portion freely contained within the circular channel and a pair of end portions each of which extends through one of the pair of apertures exteriorly of the circular channel.

A fastening member may be provided for clasping each end portion of the drawstring at different positions along the length thereof so that the diameter of the drawstring can be varied depending upon the position of the fastening member on the end portions to enable the diameter of the ring portion to be increased or reduced and thereby adjust the fit of the sports hat on a user's head.

In a preferred embodiment, the ring portion comprises a flat strip folded approximately in half lengthwise and fixed together at an open end to define the circular channel, the elasticized means comprises an elastic band stitched to the flat strip along substantially the entire length thereof; and the elongate member is a drawstring located in the circular channel between the elastic band and the flat strip. Alternatively, the drawstring can be located within the elastic band.

The sports hat preferably has a hook member attachable to a wet suit or other clothing worn by a user thereof, and a chin strap, conveniently an elasticized belt.

The sports hat may be comprised of a material which is impervious to water; material which resists water retention;

material which maintains warmth produced by body heat of a user thereof; and/or a material which breathes.

DETAILED DESCRIPTION OF THE INVENTION

Figure 1:
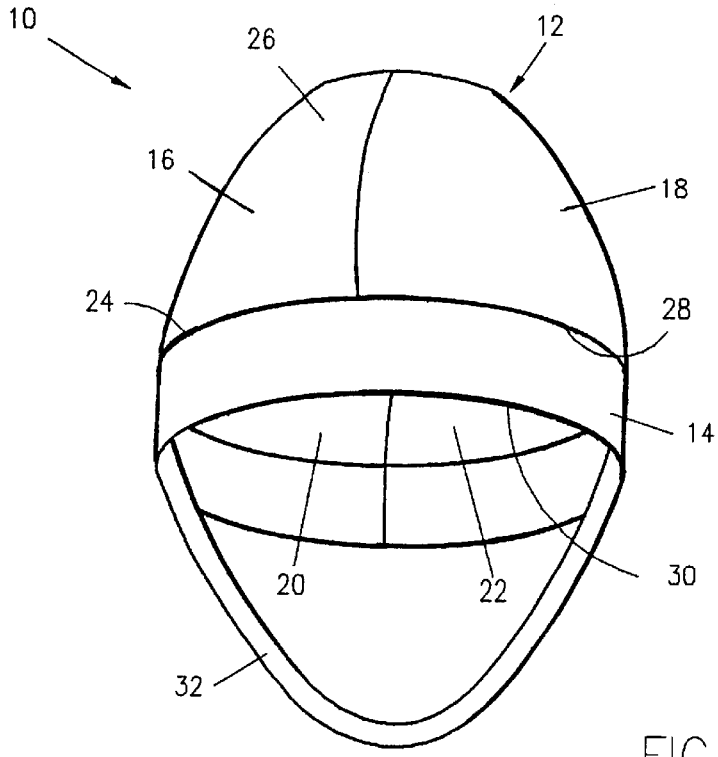
FIG. 1 is a perspective front view of sports hat of the invention.

The accompanying drawings show various embodiments and views of the sports hat of the invention, as well as the construction thereof. In FIG. 1, there is shown a sports hat 10 which comprises a domed portion 12 and a headband 14. The domed portion 12 has two front panels 16 and 18, and two rear panels 20 and 22, the various panels 16, 18, 20 and 22 being stitched together, as will be described, to form the dome. The dome 12 has a lower peripheral edge 24, and is somewhat triangular or pyramidal in shape, with a narrowed peak 26. At the lower peripheral edge 24 of the domed portion, the headband 14 is attached. The headband 14 has a fixed outer edge 28 which is sewn to the domed portion 12, and a hemmed edge 30. As shown in FIG. 1, a chin strap 32 is provided, which is sewn onto the lateral portions of the headband 14, to be described in a somewhat more detail below.

Figure 2:
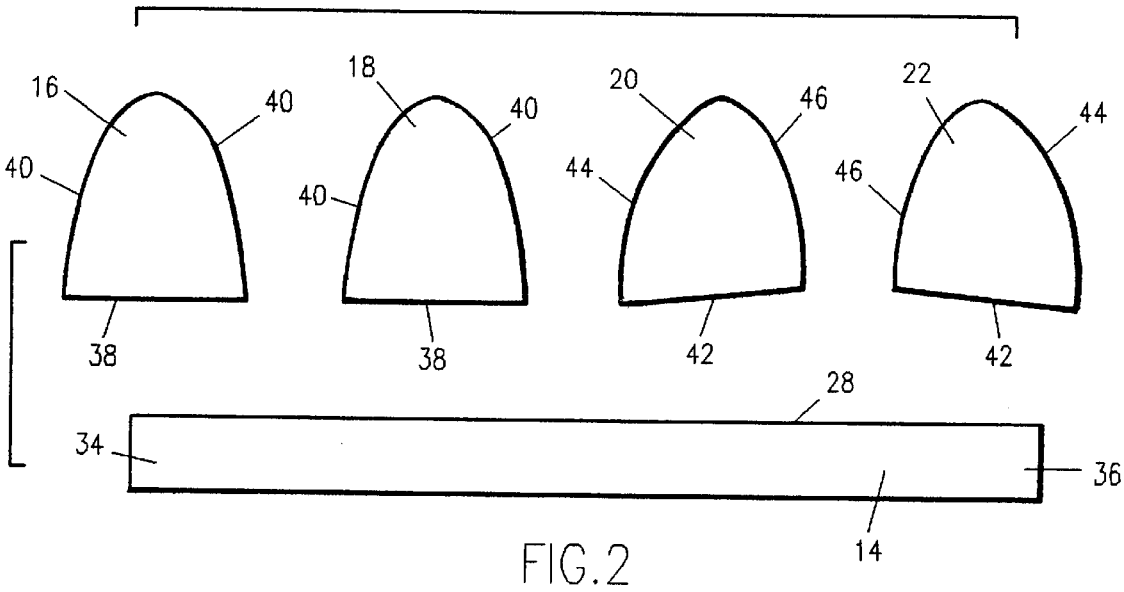
FIG. 2 is an exploded view showing some of the various components of the sports hat of the invention illustrated in FIG. 1 of the drawings.

FIG. 2 shows an exploded view of the various panels 16, 18, 20 and 22 and headband 14 of the hat 10 shown in FIG. 1 of the drawings. The two front panels 16 and 18 are shown individually, as are the two rear panels 20 and 22. The elongate strip forming the headband 14 is shown, and has ends 34 and 36 which are sewn together to form a circular loop to which the various panels are attached.

As will be noted in FIG. 2, the two front panels 16 and 18 are substantially identical, and are of the approximate shape of an isosceles triangle, including a base 38 and sides 40. The two rear panels 20 and 22 are also identical to each other, but are of a slightly different shape to the front panels 16 and 18. Each rear panel 20 and 22 is triangular in shape, but has a base 42 which is inclined, or oblique. Each rear panel 20 and 22 has a long side 44 and a short side 46.

In constructing the domed portion, the front panels 16 and 18 are assembled to each other along a side 40 thereof. Further, the rear panels 20 an 22 are assembled to each other by stitching them together along their short sides 46. Finally, the rear panels 20 and 22 are stitched to the front panels 16 and 18 by connecting a long side 44 of panel 22 to side 40 of front panel 18, and the long side 44 of panel 22 to the side 40 of front panel 16. Connecting the panels in the manner indicated creates the domed portion 12, to which the circularly constructed headband is attached. The bases 38 of front panels 16 and 18, and bases 42 of rear panels 20 and 22 are stitched to the outer edge 28 of the headband 14.

The effect of the cut-away or oblique base 42 on each of the rear panels 20 and 22 is to cause the hat 10, when worn on the user's head, to be slightly elevated or raised at the back of the head. This is useful, particularly for a surfer, to ensure that the back of the hat does not constantly rub against, or be pushed upwardly by, a wet suit worn by the user, which often comes high on to the neck. The oblique cut-away portions are therefore designed to accommodate, without interference, the high collar portion of a wetsuit so as to be somewhat complementary therewith.

Figure 3:
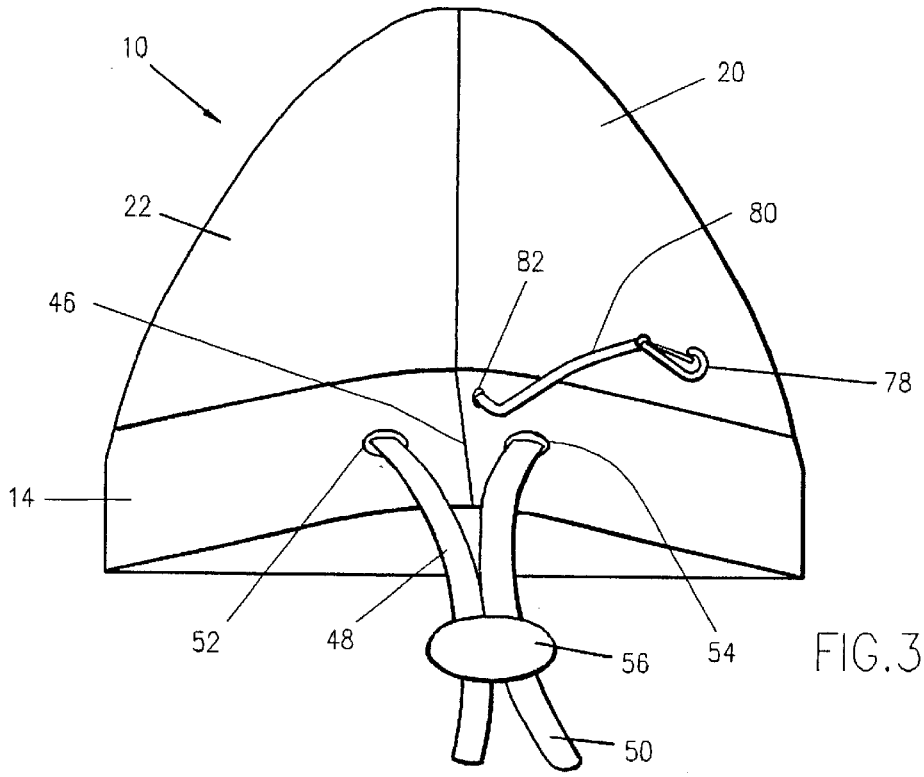
FIG. 3 is a rear view of the sports hat of the invention shown in FIG. 1.

FIG. 3 shows a rear view of the sports hat 10 illustrated in FIG. 1 of the drawings, and in which can be seen the two rear panels 20 and 22, and the headband 14. Further, the headband 14, joined at its ends 34 and 36, form the seam 46 shown in FIG. 3 of the drawings. AS will be described with reference to FIG. 4, the headband 14 has a drawstring running through it, the drawstring having a first end 48 and a second end 50 extending through apertures 52 and 54 respectively in the headband 14. The first end 48 and second end 50 are clamped together using a fastener 56, which may comprise a barrel cinch, clasp or other mechanism which can hold the first and second ends 48 and 50 of the drawstring firmly with respect to each other, so that the drawstring can be tightened to the desired tension. The fastener 56 is, of course, adjustable so that it can be manipulated to either release the ends 48 and 50, or grasp them, as needed.

Figure 4:
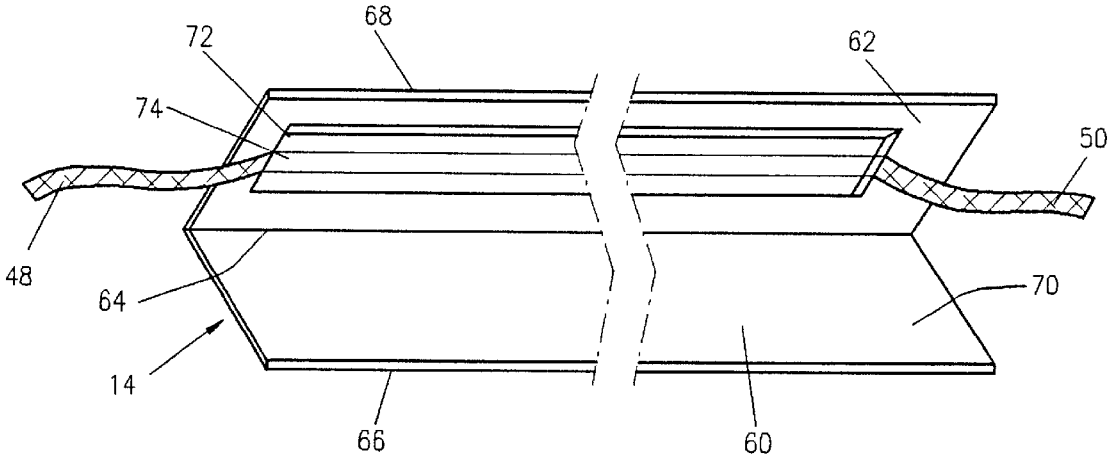
FIG. 4 is a schematic view of the headband of the sports hat of the invention, when opened or separated, showing the contents and construction thereof.

Reference is now made to FIG. 4 of the drawings which shows a detailed view of the headband 14, which forms part of the hat 10. The headband 14 comprises a thick band having a first elongate portion 60, and a second elongate portion 62, the first and second elongate portions 60 and 62 being separated by an approximately center fold 64. The first and second elongate portions 60 and 62 are folded about the center fold 64, and their free ends 66 and 68 substantially overlie each other, and are ultimately stitched closed. When stitched closed, the first 60 and second 62 elongate portions define a tubular or flat channel 70. An elastic band or strip 72 is stitched to the second elongate portion 62, and a drawstring 74 runs through the space between the elastic band 72 and the second elongate portion 62. The portions projecting outwardly from this space are threaded through apertures 52 and 54 respectively, and, outside of the hat, constitute the first end 48 and second end 50, shown in FIGS. 3 and 6 of the drawings.

The headband 14 in FIG. 4 would normally comprise a fabric which has some resilience and stretchability. The headband 14 can thus stretch, although, when in a somewhat stretched position, the elastic band 72 would provide additional pull or forces on the headband 14, tending to make the loop defined by the headband 14 smaller, and so forming a stronger connection with the head to retain the hat on the head in more rough conditions.

The drawstring 74, which is generally without stretching capabilities, is able to move freely in the space between the elastic band and the second elongate portion 62 and, therefore, pulling the first end 48 and second and 50 through the fastener 56 has the effect of further tightening, or loosening, the headband 14 when mounted on the head.

Reference is now made to FIG. 3, which shows a hook 78 attached to a length of cord or string 80, with the end of the cord 80 remote from the hook 78 being suitably stitched to the headband at connection point 82. In practice, the hook 78 can be attached to the user's wetsuit, or other clothing, thus providing an anchor or base for the sports hat 10 when not being worn by the user. The hook is useful in two conditions. First, if a forceful wave should knock the hat off the user's head, it will not be lost, but will remain attached to the wetsuit. Second, the user may simply decide to remove the hat, since it may be too warm, in which case he or she may simply pull the hat off and release it, without having to worry about storing it when not in use.

Figure 5:
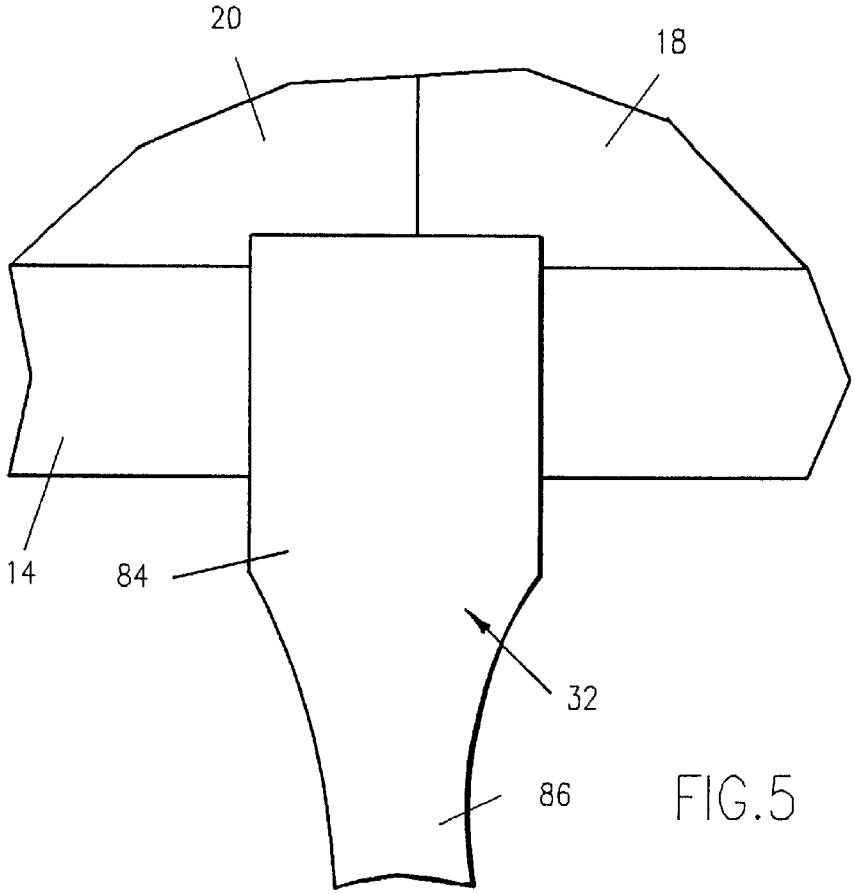
FIG. 5 is a detailed view showing the attachment of the chin strap to the inside of the sports hat of the invention.

FIG. 5 of the drawings shows a detail of one embodiment of the chin strap 32 attached to the headband 14. In the embodiment shown in FIG. 5, the chin strap 32 has a broader portion 84, at each end thereof where it attaches to the headband 14 (only one such broader portion is shown in FIG. 5 of the drawings) and a narrower portion 86 which passes around the face and chin of the user, providing an additional base and mechanism whereby the hat can remain on the head. In the embodiment shown in FIG. 5, it will be noted that approximately one third of the broader portion 84 overlaps with the front panel 18, while about two thirds thereof overlaps with the rear panel 20.

The chin strap 32 is an optional accessory for use by the user, and, if not desired, can simply be pushed into the hat to be stored without discomfort or inconvenience to the user.

Figure 6:
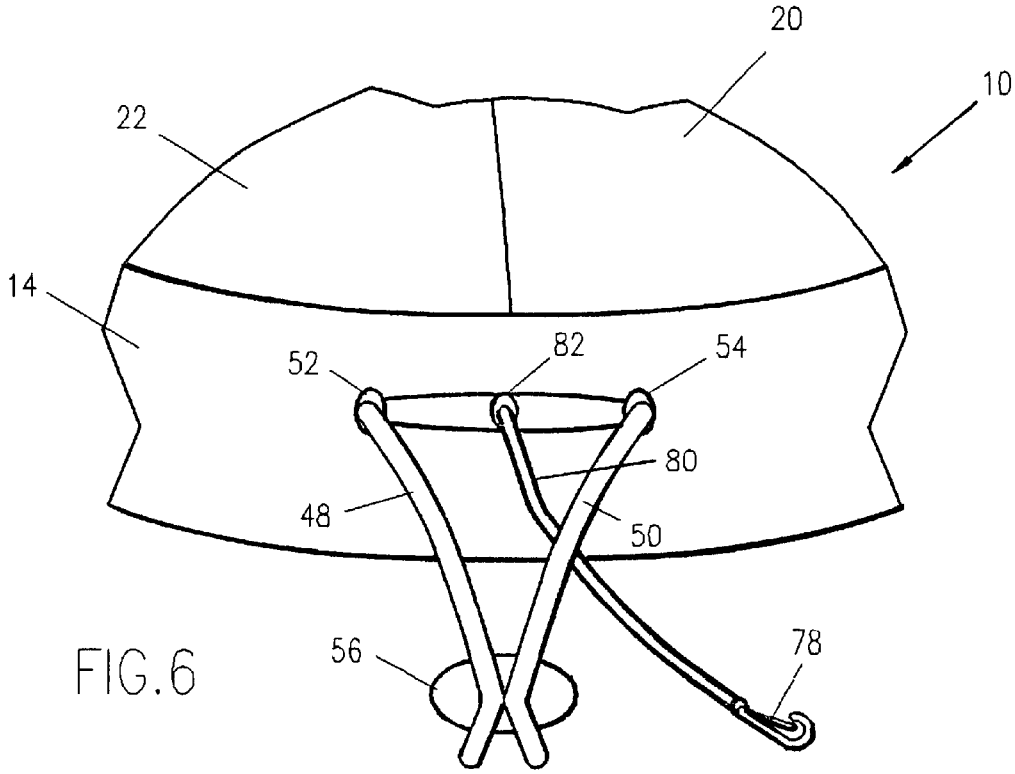
FIG. 6 is a detailed view of the back portion of the sports hat showing the various controls and attachments.

FIG. 6 is a detailed view of the back portion of the hat 10 showing a little more clearly the various components already illustrated in other drawings. Thus, the headband 14 contains the apertures 52 and 54 through which the first end 48 and second end 50 of drawstring 74 extend, and are held together in variously adjusted positions by the fastener 56. The hook 78 is attached to cord 80, which is firmly secured at connection point 82 to the back of the hat.

What is claimed is:

1. A sports hat comprising:

a body including a domed portion having a narrow end and an open wide end, and a ring portion of variable diameter at the narrow end, the ring portion having a closed channel along at least a part thereof;

an elasticized means located within the closed channel and adjacent the ring portion; and a substantially non-stretchable elongate member located within the closed channel of the ring portion and having ends outside the closed channel, the elongate member being slidable within the closed channel so that the ring portion is adjustable between a loosened position and a tightened position to limit the diameter of the ring portion.

2. A sports hat as claimed in claim 1 wherein the domed portion has a front and a rear, and the rear has a cutaway section at or near the wide end thereof.

3. A sports hat as claimed in claim 1 wherein the domed portion has a pair of front panels and a pair of rear panels, each panel comprising approximately one quarter of the domed portion.

4. A sports hat as claimed in claim 3 wherein:

each of the front panels is substantially triangular in shape with a pair of substantially equal side edges and a base edge, and each of the rear panels is substantially triangular in shape with a longer and a shorter side edge and a base edge;

the shorter side edges of adjacent rear panels are fixed to each other, the longer side edge of a rear panel is fixed to a side edge of the front panel, and the pair of front panels are fixed to each other along adjacent side edges; and the ring portion is fixed to the base edges of the front and rear panels.

5. A sports hat as claimed in claim 1 wherein the closed channel of the ring portion is a circular channel and the elasticized means and the elongate member are at least partially located within the circular channel.

6. A sports hat as claimed in claim 5 wherein the ring portion has a pair of apertures near the rear thereof, and the elongate means has a closed-in portion freely contained within the circular channel and a pair of end portions each of which extends through one of the pair of apertures exteriorly of the circular channel.

7. A sports hat as claimed in claim 6 wherein the elongate means is a drawstring.

8. A sports hat as claimed in claim 7 further comprising a fastening member for clasping each end portion of the drawstring at different positions along the length thereof so that the diameter of the drawstring can be varied depending upon the position of the fastening member on the end portions to enable the diameter of the ring portion to be increased or reduced and thereby adjust the fit of the sports hat on a user's head.

9. A sports hat as claimed in claim 8 wherein the fastening member is of a cinch barrel type.

10. A sports hat as claimed in claim 5 wherein;

the ring portion comprises a flat strip folded approximately in half lengthwise and fixed together at an open end to define the circular channel;

the elasticized means comprises an elastic band stitched to the flat strip along substantially the entire length thereof; and the elongate member is a drawstring located in the circular channel between the elastic band and the flat strip.

11. A sports hat as claimed in claim 1 further comprising a hook member attachable to a wet suit or other clothing worn by a user thereof.

12. A sports hat as claimed in claim 11 wherein the hook member is located on the ring portion near a rear of the sports hat, and is mounted on a cord having a first end attached to the ring portion and a second end attached to the hook member.

13. A sports hat as claimed in claim 1 further comprising a chin strap.

14. A sports hat as claimed in claim 13 wherein the chin strap is an elasticized belt having ends thereof attached at opposing sides of the hat, the chin strap being movable to a stored position inside the domed portion of the sports hat when not in use.

15. A sports hat as claimed in claim 1 wherein the sports hat is comprised of a material which is impervious to water.

16. A sports hat as claimed in claim 1 wherein the sports hat is comprised of a material which resists water retention.

17. A sports hat as claimed in claim 1 wherein the sports hat is comprised of a material which maintains warmth produced by body heat of a user thereof.

18. A sports hat as claimed in claim 1 wherein the sports hat is comprised of a material which breathes.

19. A sports hat as claimed in claim 1 wherein the sports hat is comprised of neoprene.

20. A sports hat as claimed in claim 1 wherein the sports hat is comprised of polyester quick to dry fleece material.

* * * * *